US010153545B2

(12) United States Patent
Stratis et al.

(10) Patent No.: US 10,153,545 B2
(45) Date of Patent: Dec. 11, 2018

(54) SYSTEMS AND TECHNIQUES FOR IMPROVING SIGNAL LEVELS IN A SHADOWING REGION OF A SEEKER SYSTEM

(71) Applicant: Raytheon Company, Waltham, MA (US)

(72) Inventors: Glafkos K. Stratis, Tucson, AZ (US); Jerry D. Robichaux, Tucson, AZ (US); Wayne L. Sunne, Tucson, AZ (US); Jim R. Hicks, Tucson, AZ (US); David G. Derrick, Vail, AZ (US); Alphonso A. Samuel, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 219 days.

(21) Appl. No.: 15/084,753

(22) Filed: Mar. 30, 2016

(65) Prior Publication Data

US 2017/0288303 A1 Oct. 5, 2017

(51) Int. Cl.

| | |
|---|---|
| ***H01Q 13/00*** | (2006.01) |
| ***H01Q 1/42*** | (2006.01) |
| ***H01Q 1/36*** | (2006.01) |
| ***H01Q 21/20*** | (2006.01) |

(52) U.S. Cl.

CPC ..... *H01Q 1/42* (2013.01); *H01Q 1/362* (2013.01); *H01Q 21/20* (2013.01)

(58) Field of Classification Search

CPC ..... H01Q 1/42
USPC ..... 343/784
See application file for complete search history.

(56) References Cited

U.S. PATENT DOCUMENTS

2007/0252748 A1* 11/2007 Rees ..... H01Q 1/28 342/29

* cited by examiner

*Primary Examiner* — Graham Smith
(74) *Attorney, Agent, or Firm* — Daly, Crowley, Mofford & Durkee, LLP

(57) ABSTRACT

The present disclosure is directed to a seeker system having an infrared (IR) sensor pedestal, an IR sensor disposed on the IR pedestal and a plurality of radio frequency (RF) antenna elements symmetrically disposed in a circumferential direction around the IR sensor pedestal. The seeker system further includes a plurality of RF waveguiding structures. In an embodiment, each of the RF waveguiding structures have first and second ends and are symmetrically disposed in a circumferential direction around the IR sensor pedestal such that in response to an RF signal incident on a first end of the waveguiding structure, the RF signal is provided to one of the plurality of RF antenna elements such that in response to an RF signal incident on the seeker system from any direction, each of the plurality of RF antenna elements receive the RF signal with a desired phase characteristic.

22 Claims, 11 Drawing Sheets

SYSTEMS AND TECHNIQUES FOR IMPROVING SIGNAL LEVELS IN A SHADOWING REGION OF A SEEKER SYSTEM

BACKGROUND

As is known in the art, so-called "shadowing effects" generally refer to the lack of a direct line of sight between an incoming radio frequency (RF) signal and a receive RF antenna. The lack of a direct line of sight may result from an angle at which an incoming RF signal impinges upon an antenna element or an array of antenna elements. For example, if an array of antenna elements are disposed about the perimeter of a structure which is not transparent to RF energy, then RF energy incident on one side of the structure will be received by RF antennas on that side of the structure, but will be blocked from being received by RF antennas on an opposite side of the structure. Hence, the "blocked" RF antennas are said to be in the "shadow" caused by the blocking structure. Additionally, in some cases the antenna elements can create shadowing with respect to each other. Since signal degradation impacts the accuracy of any angle of arrival (AoA) computations, shadowing effects can be a major source of error in a missile seeker or other radar system.

To avoid such shadowing issues, in some systems, antennas have been placed in front of and separate from the blocking structure and in some cases even outside a radome structure. In systems which include both optical (e.g. infrared) and RF sensors, the RF sensor are sometimes physically located separate from and in front of the IR sensors and may also sometimes even be placed outside a radome structure. However, additional issues occur when antennas are placed proximate to or in front of optical sensors. For example, on a missile seeker, RF antenna structures may become heated (e.g., due to friction) and thus the RF antennas can become heat radiators. This results in interference with infrared (IR) sensors when the RF antennas are proximate the IR sensors.

Other attempts to avoid the signal degradation issues have positioned the antennas outside of and some distance away from the radome structure. However, such designs limit the number of antennas that can be used in the respective radar system. Additionally such design approaches may result in aerodynamic issues for radar systems disposed on a missile.

SUMMARY

In accordance with the concepts, systems and techniques described herein, it has been recognized that there is a need for radio frequency (RF) systems (such as missile radar systems) that address shadowing effects and also meet aerodynamic requirements of the respective system. Thus, the present disclosure is directed toward systems having waveguiding structures disposed within a radio frequency (RF) radome structure to improve signal levels in a shadow region (i.e., a non-line of sight region) of a radar system.

In one embodiment, RF antenna elements are disposed around a perimeter of a mounting structure or a housing within the radome structure to receive signals incident on the seeker system from each direction. Since the RF antenna elements are disposed within the radome structure, an aerodynamic profile of the missile seeker system is not impacted.

In an embodiment, the waveguiding structures couple signals (e.g., RF signals) from a line of sight region to a non-line of sight region (i.e., a shadowing region) around the seeker system. Antenna elements disposed in the non-line of sight region receive the RF signals from the waveguiding structures. Thus, the shadowing region is reduced or eliminated as signals that were previously obstructed from reaching the shadowing regions are now coupled to the shadowing region via the waveguiding structures. In some embodiments, waveguiding structures can be configured to provide phase adjustment capabilities within the seeker system, leading to a significant improvement of where an angle of arrival algorithm can be calculated.

In one aspect, the present disclosure is directed to a seeker system. The seeker system includes an IR sensor pedestal, an IR sensor disposed on the IR pedestal and a plurality of radio frequency (RF) antenna elements symmetrically disposed in a circumferential direction around the IR sensor pedestal. The seeker system further includes a plurality of RF waveguiding structures. Each of the RF waveguiding structures have a first and a second end and are symmetrically disposed in a circumferential direction around the IR sensor pedestal such that in response to an RF signal incident on a first end of a waveguiding structure, the RF signal is provided to one of the plurality of RF antenna elements such that in response to an RF signal incident on the seeker from any direction, each of the plurality of RF antenna elements receive the RF signal with a desired phase characteristic.

In another aspect, the present disclosure is directed to a radome. The radome includes a housing, which defines a radome cavity. The housing has a first surface and a second surface. The radome further includes at least one waveguiding structure, having a first end and a second end. The at least one waveguiding structure is disposed on a first one of the first and second surfaces of the housing. The radome further includes at least one antenna element disposed within the radome cavity, proximate to the second end of the waveguiding structure, and configured to receive RF energy propagating from the first end of the at least one waveguiding structure to the second end of the at least one waveguiding structure.

In some embodiments, the radome includes a phase correcting structure disposed in the waveguiding structure. The phase correcting structure may provide the phase correction in a way that the incoming wave looks like a plane wave to the antenna elements such that RF signals provided to the antenna elements have substantially the same phase.

In another aspect, the present disclosure is directed to an antenna. The antenna includes a RF radome region and a plurality of antenna elements disposed within the RF radome region. The plurality of antenna elements may be disposed around an inner surface of the RF radome region. The antenna further includes a first waveguiding structure positioned along the inner surface of the RF radome region. In an embodiment, a first end of the first waveguiding structure is in a line of sight region of the antenna and a second end of the first waveguiding structure is in a non-line of sight region of the antenna. The first waveguiding structure may be configured to couple RF energy received at the line of sight region to the non-line of sight region.

In some embodiments, the antenna includes a second waveguiding structure positioned along the inner surface of the RF radome region. The second waveguiding structure may be positioned parallel with respect to the first waveguiding structure within the RF radome region. In an embodiment, a first end of the second waveguiding structure is positioned a predetermined distance from a first end of the first waveguiding structure.

The first waveguiding structure and second waveguiding structure may include a dielectric material. The first waveguiding structure and second waveguiding structure may be provided having a tubular shape or rectangular shape.

In an embodiments, the first waveguiding structure is configured to perform phase correction on an incoming wave to make the incoming wave appear to be a plane wave to at least one of the plurality of antenna elements.

In some embodiments, the antenna elements are positioned at a bottom portion of the RF radome region with respect to a peak of the antenna. The antenna elements may be positioned within a predetermined height of a height of the first waveguiding structure.

In some embodiments, the antenna further includes an IR optics radome region coupled to a top surface of the RF radome region.

In another aspect, the present disclosure is directed to antenna having a plurality of antenna elements disposed within a radome region of the antenna. The plurality of antenna elements are disposed around an inner circumference of the radome region. The antenna further includes a first waveguiding structure positioned along the inner circumference within the radome region. A first end of the first waveguiding structure is in a line of sight region of the antenna and a second end of the first waveguiding structure is in a non-line of sight region of the antenna. In an embodiment, the first waveguiding structure is configured to couple RF energy received at the line of sight region to the non-line of sight region.

In some embodiments, the antenna includes a second waveguiding structure positioned along the inner circumference within the radome region. The second waveguiding structure may be positioned parallel with respect to the first waveguiding structure within the radome region. In an embodiment, a first end of the second waveguiding structure is positioned a predetermined distance from a first end of the first waveguiding structure.

In some embodiments, the antenna elements are positioned at a bottom portion of the radome region with respect to a peak of the antenna. For example, each of the plurality of antenna elements are disposed along a plane within the radome region, and wherein the place is positioned at a predetermined distance from a height of the first waveguiding structure.

BRIEF DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more exemplary embodiments. Accordingly, the figures are not intended to limit the scope of the invention. Like numbers in the figures denote like elements.

and

Figure 6:
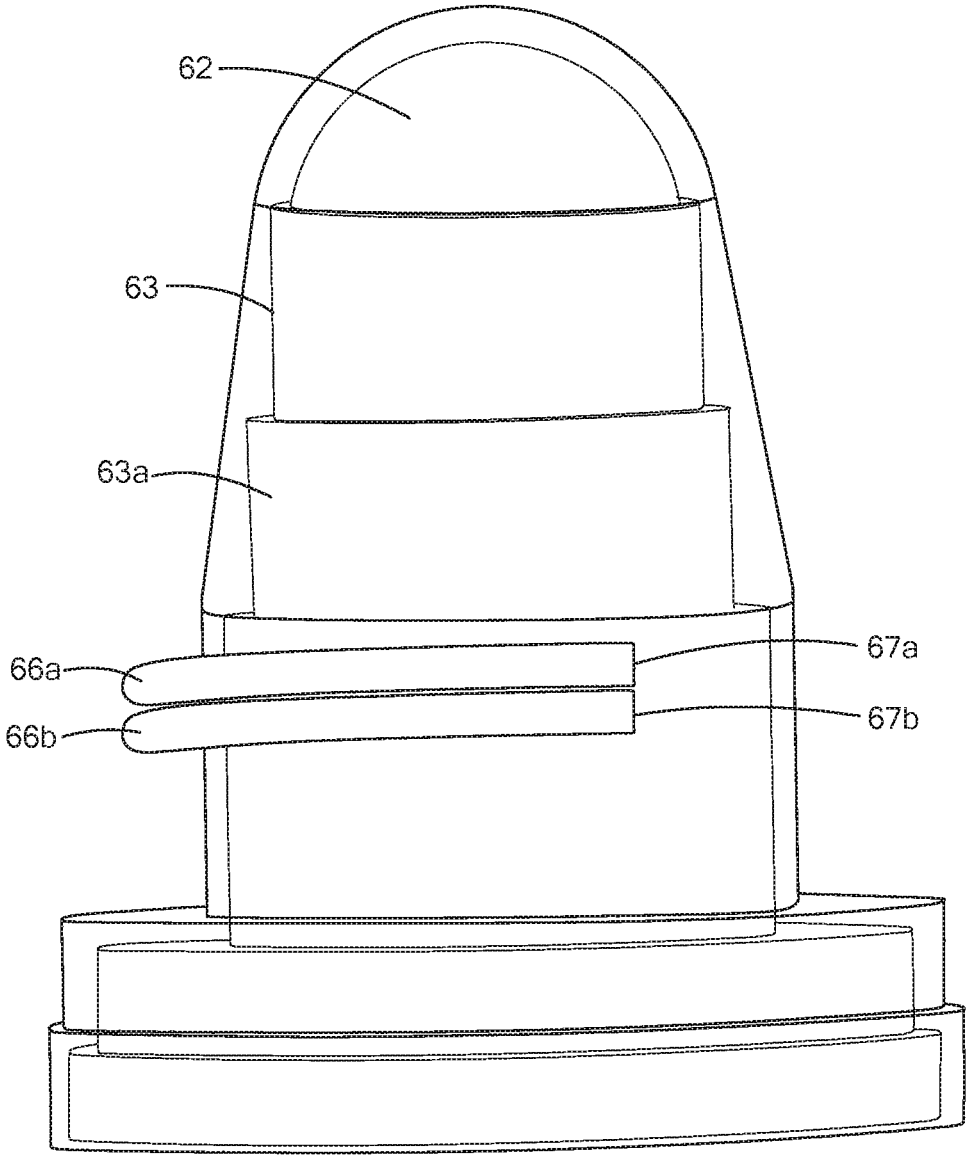
FIG. 6 is an isometric view of a seeker system with a pair of waveguiding structures.
Figure 6A:
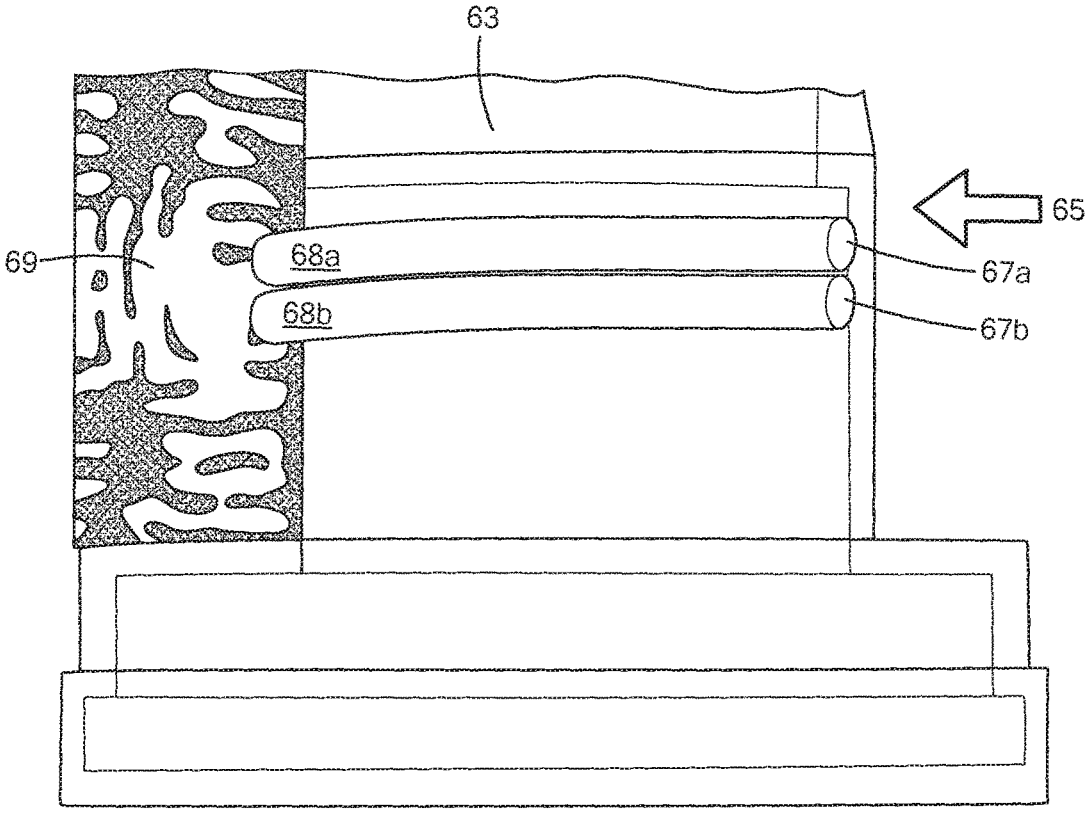

FIG. 6A is an exploded view of the seeker system of FIG. 6 illustrating the waveguiding structures coupling energy to regions around the waveguiding structure.

DETAILED DESCRIPTION

The present disclosure is directed toward a radar system such as a seeker portion of a missile. The seeker portion includes a housing (i.e., mounting structure), a plurality of radio frequency (RF) antenna elements disposed about the housing, an RF radome disposed over the housing and antenna elements and at least one waveguiding structure disposed within a cavity of the radome. In an embodiment, the housing creates a shadowing effect on regions around the missile radar system based on a direction of incoming signals, obstructing the incoming signals from reaching certain regions (i.e., non-line of sight or "shadow" regions) of the radar system. Thus, the waveguiding structure is configured to receive the incoming signals in a first region (i.e., a line of sight region) and couple (i.e., transfer) them to a shadow region (i.e., a non-line of sight region), illuminating the shadow region with the received signals.

In some embodiments, the antenna elements are disposed symmetrically in a circumferential direction around the housing within the radome cavity. The waveguiding structure can be positioned such that they provide the incoming signals to antenna elements in shadow regions with a desired phase characteristic.

Figure 1:
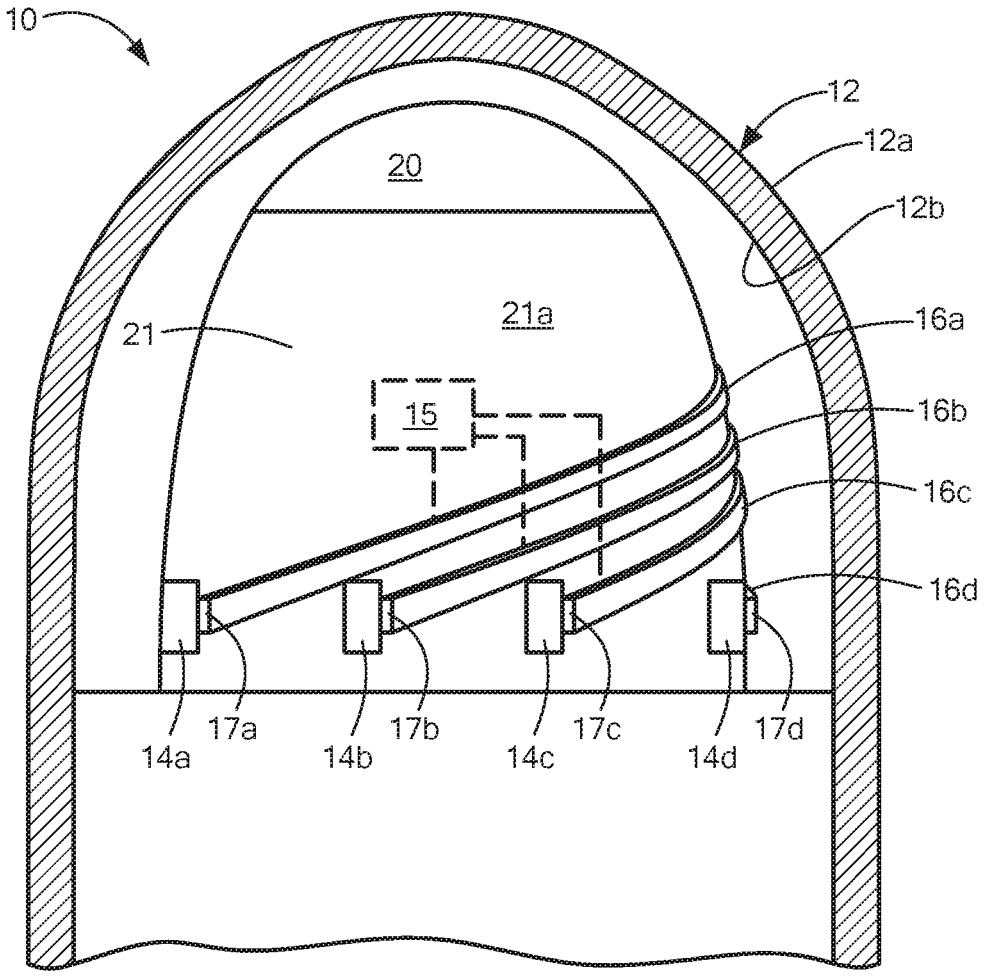
FIG. 1 is an isometric front view of one embodiment of a seeker system.

Now referring to FIG. 1, an infrared/radio frequency (IR/RF) seeker system 10 includes an IR sensor 20 and IR pedestal 21 disposed within an RF radome 12 that is disposed about an outer surface of seeker system 10. The IR sensor 20 is disposed on a top surface of the IR pedestal 21. The seeker system may generally refer to a seeker portion of a missile radar system herein.

The RF radome 12 has an inner surface 12*a*, an outer surface 12*b*, and a predetermined thickness established by the distance between inner surface 12*a* and outer surface 12*b*. In an embodiment, RF radome 21 may be a dielectric radome provided around the outer surface of seeker system 10 to, among other things, protect the internal components and circuitry seeker system 10 from an exterior environment. In some embodiments, IR sensor 20 is an IR optics radome region within RF radome 12.

IR/RF seeker system 10 further includes a plurality of antenna elements 14*a*, 14*b*, 14*c*, 14*d* and a plurality of waveguiding structures 16*a*, 16*b*, 16*c*, 16*d* disposed along an outer surface 21*a* of IR pedestal 21. The plurality of antenna elements 14 may be RF antenna elements. In an embodiment, the plurality of antenna elements 14*a*-14*d* are symmetrically disposed in a circumferential direction around outer surface 21*a* of IR pedestal 21. It should be appreciated that the plurality of antenna elements 14*a*-14*d* may be disposed on a variety of different surfaces within a cavity defined by RF radome 12. For example, the plurality of antenna elements 14*a*-14*d* may be disposed along inner surface 12*a* of RF radome 12. In other embodiments, the plurality of antenna elements 14*a*-14*d* may be positioned at a bottom portion of the RF radome 12 with respect to a peak of the seeker system 10.

The plurality of antenna elements 14*a*-14*d* may be symmetrically disposed with respect to each other. In other embodiments, antenna elements 14*a*-14*d* may be disposed such that they are off-set relative to each other or on a different surface within a cavity defined by RF radome 12 relative to another antenna element 14. For example, a first antenna element 14*b* may be disposed on outer surface 21*a*, while a second antenna element 14*b* may be disposed on inner surface 12*a*. The arrangement and positioning of antenna elements 14 can be designed based on a particular application and properties of a seeker system 10.

In the illustrative embodiment of FIG. 1, four antenna elements 14*a*-14*d* are shown. However, it should be appreciated that any number of antenna elements 14 may be disposed within seeker system 10. For example, seeker system 10 may include only one antenna element 14. In other embodiments, seeker system 10 may include an array of N antenna elements 14*a*-14*x* where N is an integer greater than 2. In still other embodiments, each antenna element 14 may be an individual array of elements.

In an embodiment, waveguiding structures 16*a*-16*d* include dielectric material (e.g. dielectric slabs or fully or partially dielectric loaded waveguides). Waveguiding structures 16*a*-16*d* may be provided having a variety of different shapes, such as tubular, rectangular or circular shape. In some embodiments, the waveguiding structures 16*a*-16*d* may include optical and/or RF paths, such as those described in co-pending U.S. patent application Ser. No. 14/836,091, filed on Aug. 26, 2015 and assigned to the assignee of the present application.

The plurality of waveguiding structures 16*a*-16*d* may be symmetrically disposed in a generally circumferential direction around outer surface 21*a* of IR pedestal 21. Each of the plurality of waveguiding structures 16 have a first end (not shown) and a second end 17*a*-17*d*. First or second ends 17*a*-17*d* may be positioned such that they align with and are proximate to at least one antenna element 14. In other embodiments, first or second ends 17*a*-17*d* may not be aligned with and proximate to at least one antenna element 14. For example, first or second ends 17*a*-17*d* may offset by a predetermined distance from at least one antenna element 14. The predetermined distance may be based on the dimensions and/or shape of the IR/RF seeker system 10. In one embodiments, the first or second ends 17*a*-17*d* may aligned with more than one antenna element 14.

The plurality of waveguiding structures 16*a*-16*d* can be configured to receive an incoming signal (e.g., RF signal) incident on a first end of at least one waveguiding structure 16 and provide the incoming signal to the at least one antenna element 14 through second end 17. Thus, in response to the incoming signal incident on the first end of at least one waveguiding structure 16, the incoming signal is provided to one of the plurality of antenna elements 14 such that in response to an incoming signal incident on seeker system 10 from any direction, each of the plurality of antenna elements 14 receive the incoming signal with a desired phase characteristic.

In some embodiments, the plurality of waveguiding structures 16*a*-16*d* are symmetrically disposed in a circumferential direction around inner surface 12*a* of RF radome 12. For example, waveguiding structures 14*a*-14*d* may be positioned such that they are spaced a predetermined distance from a neighboring or adjacent waveguiding structure 16. In other embodiments, the plurality of waveguiding structures 16*a*-16*d* may be disposed on top of one another and parallel with respect to each other. Alternatively still, the plurality of waveguiding structures 16*a*-16*d* may be disposed adjacent one another with respect to each other Waveguiding structures 16 can be positioned in a variety of arrangements based upon the needs of a particular application and radar system. For example, in some embodiments, waveguiding structures 16*a*-16*d* may be disposed such that each feeds a different region around the seeker system 10 or such that one or more waveguiding structures 16*a*-16*d* feed different regions. In one embodiment, the regions around the seeker system 10 may be organized as quadrants and each waveguiding structures 16*a*-16*d* may feed a different quadrant around seeker system 10.

In some embodiments, a phase control circuitry 15 is coupled (e.g., directly coupled or communicatively coupled) to each of the plurality of waveguiding structures 16*a*, 16*b*, 16*c*, 16*d*. The phase control structure may provide the phase correction in a way that the incoming wave looks like a plane wave to the antenna elements 14 such that RF signals provided to the antenna elements 14 have substantially the same phase. In one embodiment, the phase control circuitry 15 may include dynamic phase shifters.

In some embodiments, a shape or length of the waveguiding structures 16*a*-16*d* may provide the phase correction. For example, waveguiding structures 16*a*-16*d* may be formed in a zig-zag shape or helical shape. Changes or fluctuations in the physical configuration of the waveguiding structures 16*a*-16*d* (e.g., in a zig-zag shape or helical shape) can be designed to bring a phase at the end of the waveguiding structure to the same level as at the beginning waveguiding structures 16*a*-16*d*. The length and dimensions of the zig-zag pattern or helical shape (e.g., length of individual coils) may be selected in order to achieve a desired or appropriate phase correction in relationship to a distance from one side of the seeker system 10 to an opposite side of the seeker system 10. In some embodiments, the line of sight region maybe used a first reference point and the non-line of sight region (e.g., shadowing region) may be used a second reference point. In an embodiment, using a distance from the first reference point to the second reference point, appropriate lengths and dimensions of the zig-zag or helical shaped waveguiding structures 16*a*-16*d* may be selected. Thus, the phase adjustment can be provided based on the physical configuration of the waveguiding structures 16*a*-16*d*.

In the illustrative embodiment of FIG. 1, four waveguiding structures 16*a*-16*d* are shown. However, it should be appreciated that any number of waveguiding structures 16 may be disposed around seeker system 10. In some embodiments, the number of waveguiding structures 16*a*-16*d* may depend on the dimensions of a particular seeker system 10 and/or a frequency of an incoming signal.

As stated above, seeker system 10 may be designed with a variety of different types of antenna elements 14 and/or waveguiding structures 16. In some embodiments, waveguiding structures 16 may be designed or formed based on a particular type of antenna element 14 that the respective waveguiding structure 16 is aligned with.

Figure 1A:
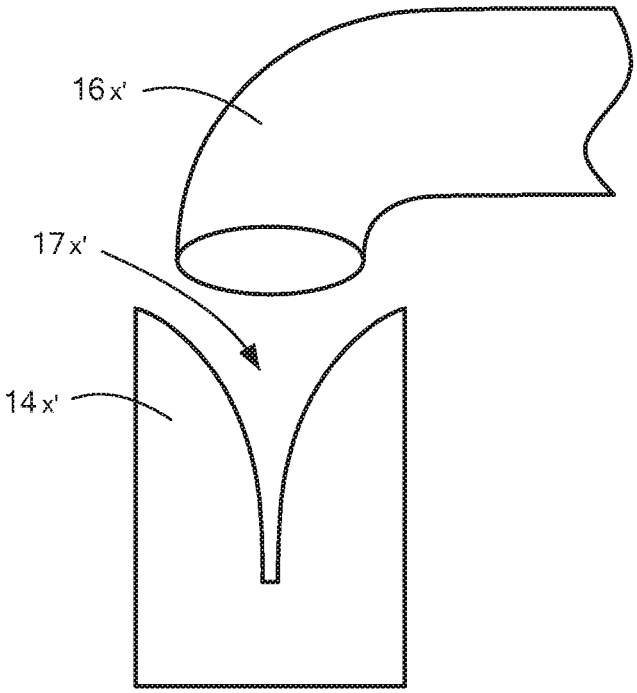
FIG. 1A is an isometric view of one embodiment of a waveguiding structure feeding a Vivaldi antenna.

For example and referring to FIG. 1A, antenna element 14*x*' is a Vivaldi antenna or notch antenna and a waveguiding structure 16*x*' is positioned to provide signals to antenna element 14*x*' in a top-down fashion. The Vivaldi antenna 14*x*' is a co-planar broadband-antenna having a gap region

17$x'$ formed between two generally symmetric sides, whereby the gap region 17$x'$ operates as a radiating element. In the illustrative embodiment of FIG. 1$a$, the gap region 17$x'$ is radiating in an upward direction and thus, waveguiding structure 16$x'$ can be positioned to couple signals to the gap region 17$x'$ of antenna element 14$x'$. It should be appreciated that waveguiding structure 16$x'$ can be positioned to couple signals to antenna element 14$x'$ in any direction based on a direction gap region 17$x'$ is facing or radiating energy. Further, waveguiding structure 16$x'$ can be formed in a variety of different shapes based on a particular application or design of antenna element 14$x'$.

Figure 1B:
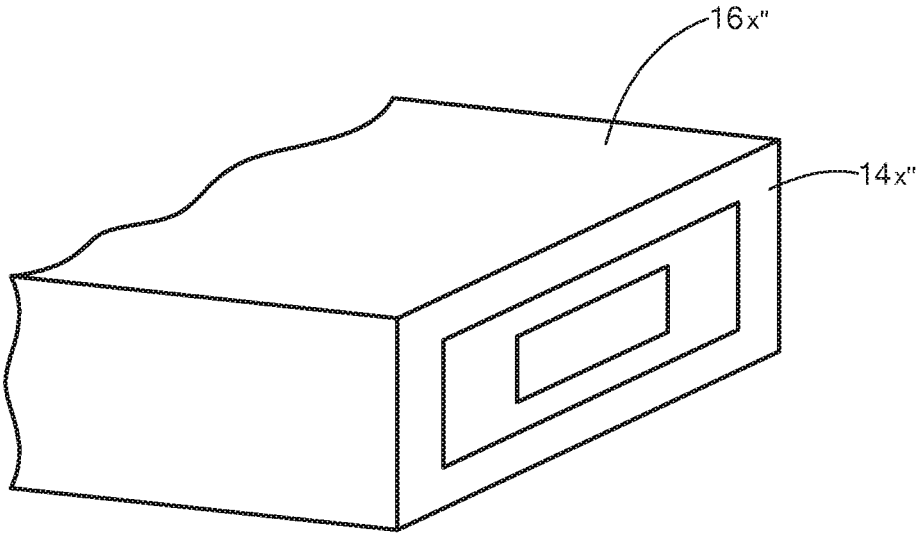
FIG. 1B is an isometric view of another embodiment of a waveguiding structure.

For example and referring to FIG. 1B, an antenna element 14$x''$ (i.e., antenna aperture) is disposed in an open end of a waveguiding structure 16$x''$. Waveguiding structure 16$x''$ has a rectangular shape and a rectangular open end. In an embodiment, waveguiding structure 16$x''$ operates as a feed structure or circuit. In one embodiment, waveguiding structure 16$x''$ and antenna elements 14$x''$ are provided as the type described in co-pending U.S. patent application Ser. No. 14/971,223, filed on Dec. 16, 2015 and assigned to the assignee of the present application.

In some embodiment, waveguiding structure 16$x$ and antenna elements 14$x$ may be configured for forward transmission/reception. In some embodiments, the antenna elements 14$x$ may be provided as slot antennas, aperture antennas or dipole elements. The type antenna elements used may depend on an orientation of the antenna element with respect to the waveguide and/or the RADOME.

Figure 2A:
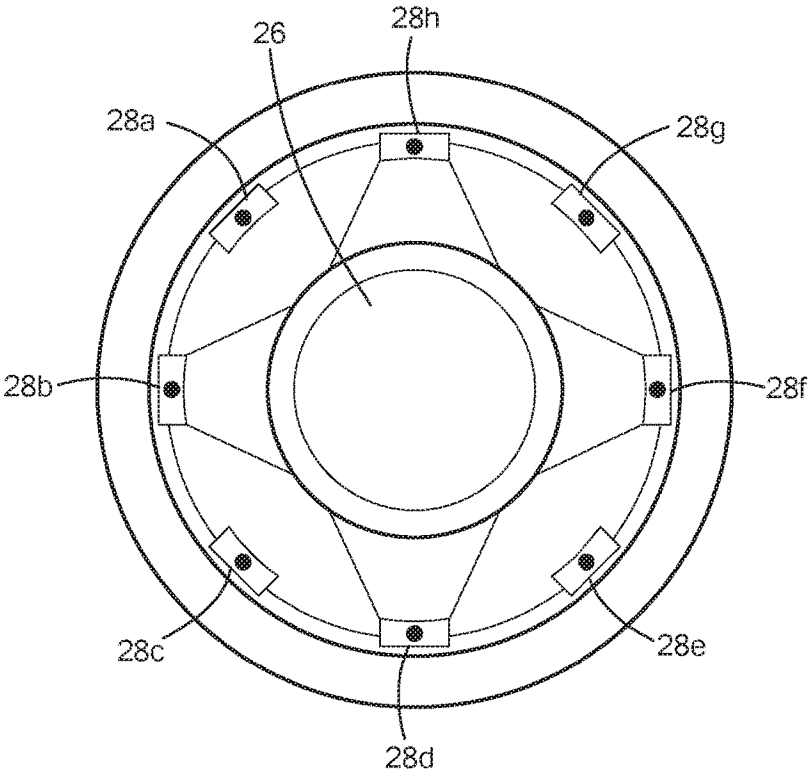
FIG. 2A is an isometric top view of the seeker system from FIG. 2.
Figure 2:
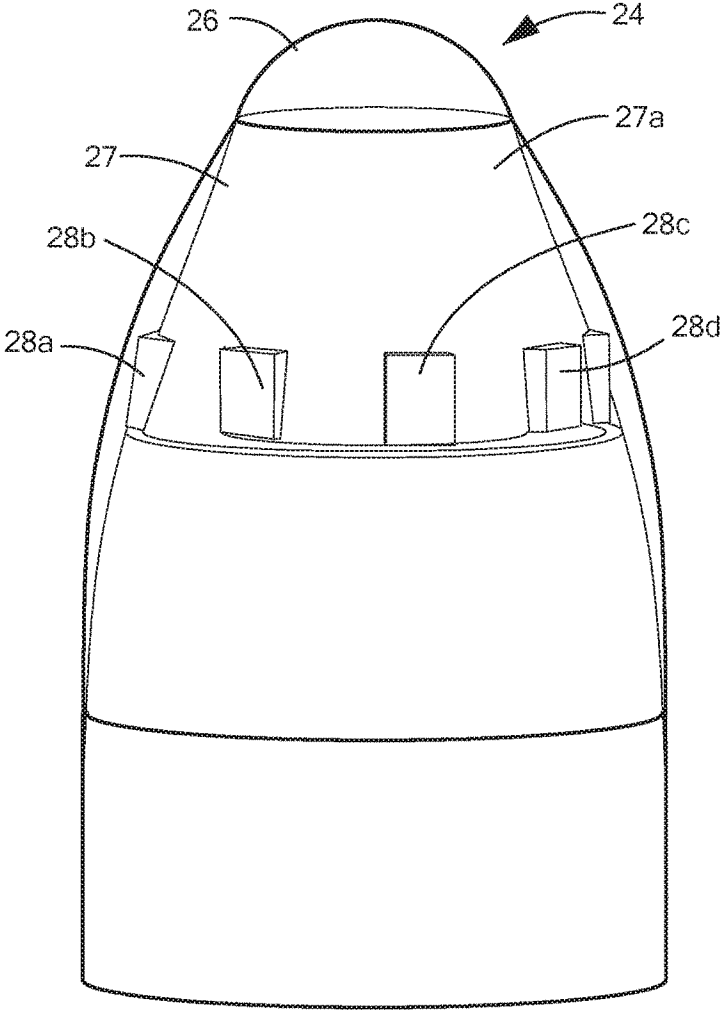
FIG. 2 is an isometric side view of one embodiment of a seeker system.

Now referring to FIG. 2, a seeker system 24 includes a sensor 26 disposed on a top surface of a pedestal 27. A plurality of antenna elements 28$a$-28$d$ are disposed along an outer surface 27$a$ of pedestal 27. The plurality of antenna elements 28$a$-28$d$ are symmetrically disposed in a circumferential direction around the outer surface 27$a$.

Sensor 26 may be any type of sensor including an IR optics sensor. In some embodiments, sensor 26 may be an RF sensor. The RF sensor may be enclosed in the sensor 26 and isolated from antenna elements 28$a$-28$d$.

Antenna elements 28$a$-28$d$ may be positioned at a predetermined height of outer surface 27$a$ (e.g., lower portion, middle portion, upper portion). For example, antenna elements 28$a$-28$d$ may be positioned at a bottom portion of pedestal 27 relative to a peak of seeker system 24. In some embodiments, each of the antenna elements 28$a$-28$d$ are positioned at the same height or level along outer surface 27$a$. In other embodiments, one or more antenna elements 28$a$-28$d$ may be positioned at different heights or levels along outer surface 27$a$.

Antenna elements 28$a$-28$d$ may be positioned such that they align with first or second ends of waveguiding structures, as shown in FIG. 1. In some embodiments, antenna elements 28$a$-28$d$ are positioned within a predetermined height or spaced a predetermined distance from a height of at least one waveguiding structure. For example, one or more of the plurality of antenna elements 28$a$-28$d$ may be disposed along a plane within a radome region, whereby the plane is positioned at a predetermined distance from a height of a waveguiding structure. It should be appreciated however, that a location of the antenna elements 28$a$-28$d$ may depend on the dimensions and/or shape of the seeker system 24. In some embodiments, the location of the antenna elements 28$a$-28$d$ and the distance with respect to another or neighboring antenna elements may be depend on a particular polarization or space diversity scheme for the seeker system 24.

Now referring to FIG. 2A, a top view of seeker system 24 is shown having the plurality of antenna elements 28$a$-28$h$ symmetrically disposed in a circumferential direction around the outer surface 27$a$. In an embodiment, antenna elements 28$a$-28$h$ are disposed completely around outer surface 27$a$ such that an signal incident on seeker system 24 in any direction is received by at least one antenna element 28. Thus, seeker system has 360° coverage to detect and receive incoming signals as each region around seeker system 24 is aligned with or includes at least one antenna element 28.

Figure 3:
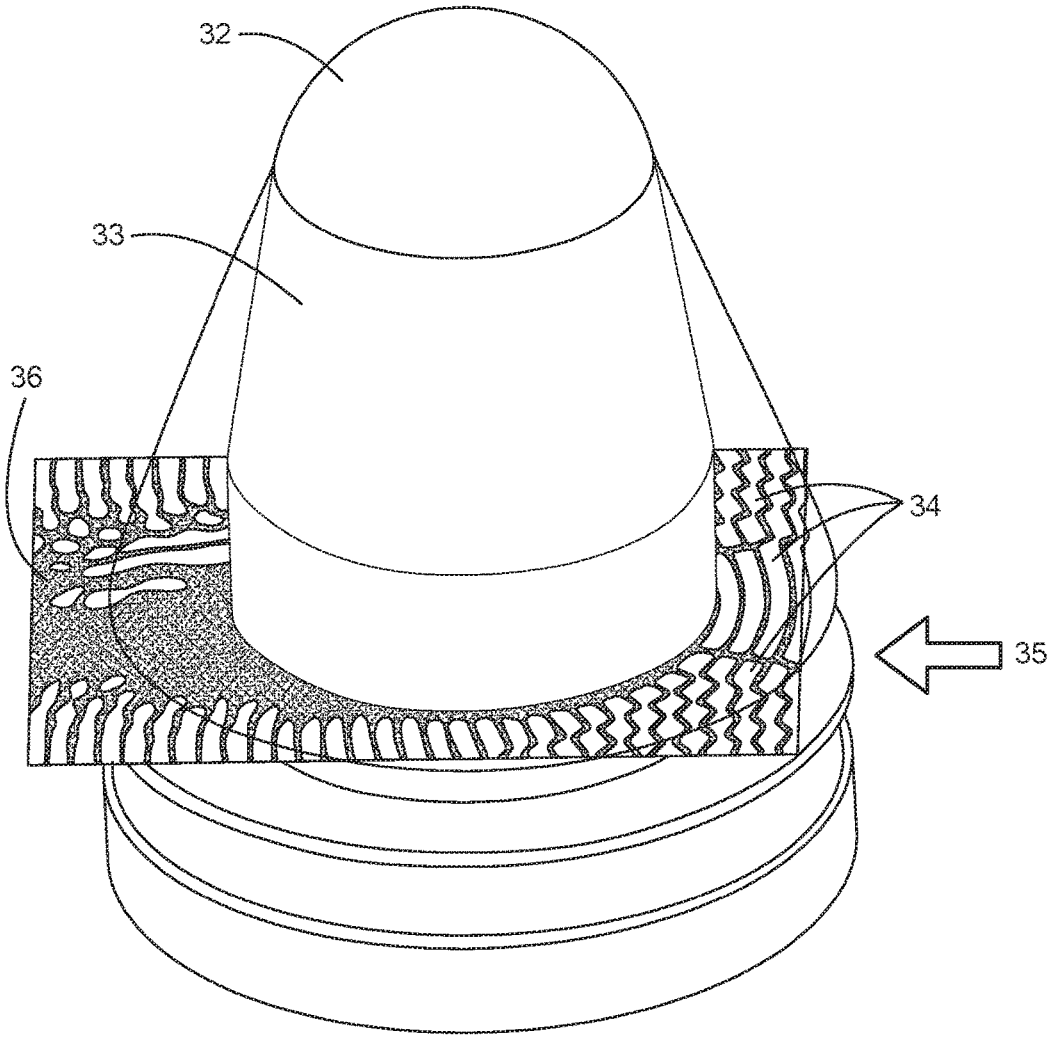
FIG. 3 is an isometric side view of one embodiment of a seeker system illustrating one embodiment of the effects of shadowing on a seeker system.

Now referring to FIG. 3, a seeker system 30 includes a sensor 32 and a sensor pedestal 33. Seeker system 30 further includes a line of sight region 34, a non-line of sight region 36 and incoming signals 35. Pedestal 33 may be a housing or mounting structure. In an embodiment, the physical structure size and shape of sensor 32 and sensor pedestal 33 may cause shadowing in regions around seeker system 30, negatively impacting the performance of antenna elements within the seeker system 30, such as the antenna elements shown in FIGS. 1-2A. Thus, line of sight region 34 and non-line of sight region 36 are formed based on the properties (e., g. a size, a shape) of sensor 32 and pedestal 33, as well as a direction of incoming signals 35.

Figure 3A:
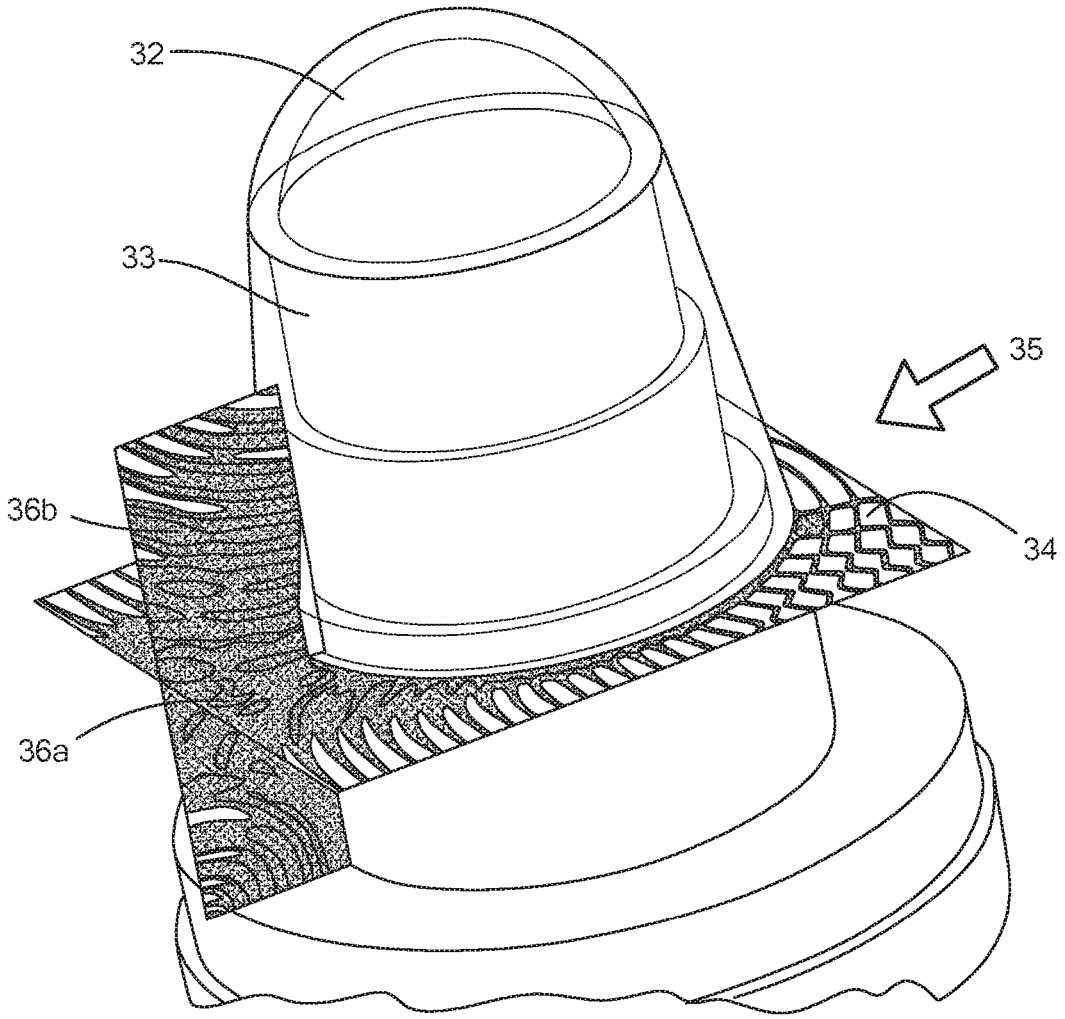
FIG. 3A is a second isometric side view of the seeker system from FIG. 3.

For example, depending on a direction of incoming signals 35, a region opposite the region receiving the incoming signals 35 may be blocked from receiving the incoming signals 35. In the illustrative embodiment of FIG. 3, line of sight region 34 receives the incoming signals 35 and non-line of sight region 36 is blocked from receiving the incoming signals 35. Line of sight region 34 may include the region directly in the path of the incoming signals 35 and in front of sensor 32 and pedestal 33. Line of sight region 34 may also include regions to the left or right of the direct path region, such as a side portion of sensor 32 and pedestal 33. However, non-line of sight region 36 is positioned directly behind the sensor 32 and pedestal 33 and receives very little of the incoming signals 35 or nothing at all. For example, FIG. 3A illustrates the shadowing effect on non-line of sight region 36 in both a horizontal plane 36$a$ and a vertical plane 36$b$. Thus, there exists a need to couple incoming 35 signals from line of sight region 34 to non-line of sight region 36.

Figure 4:
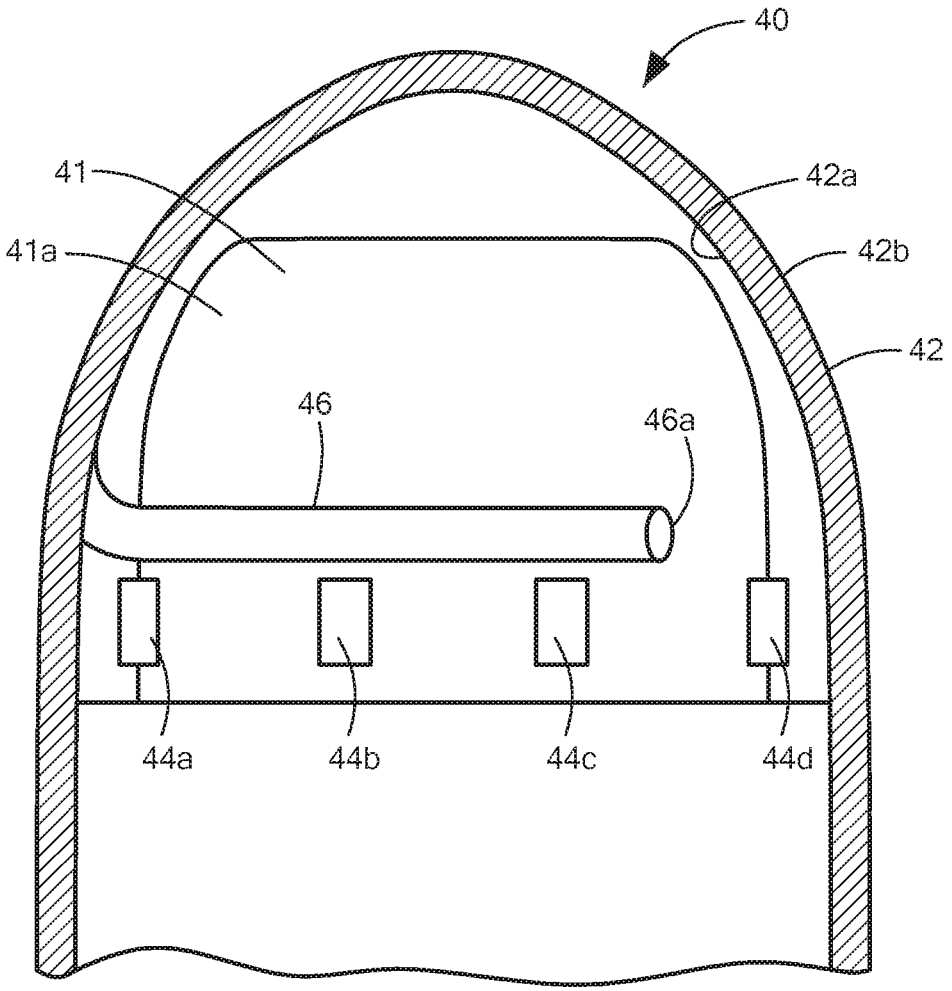
FIG. 4 is an isometric view of one embodiment of a seeker system.

Now referring to FIG. 4, a seeker system 40 includes a housing 41 and an RF radome 42 disposed around housing 41. Housing 41 may define a radome cavity and have an outer surface 41$a$ and an inner surface (not shown). In an embodiments, outer surface 41$a$ and an inner surface may also be referred to as a first and second surface. RF radome 42 has an inner surface 42$a$, outer surface 42$b$ and a predetermined thickness based on a distance between an edge of inner surface 42$a$ and an edge of outer surface 42$b$.

Seeker system 40 further includes a plurality of antenna elements 44$a$-44$d$ and a waveguiding structure 46 disposed around outer surface 41$a$ of housing 41. In some embodiments, the plurality of antenna elements 44$a$-44$d$ and waveguiding structure 46 may be disposed around inner surface 42$a$ of RF radome 42. The plurality of antenna elements 44$a$-44$d$ may be symmetrically disposed in a circumferential direction around either the outer surface 41$a$ or inner surface 42$a$.

In an embodiment, housing 41 may cause shadowing in regions around seeker system 40 based on its properties and a direction of an incoming signal. Waveguiding structure 46 may be positioned along outer surface 41$a$ or inner surface 42$a$ to couple incoming signals from a line of sight region to antenna elements 44 in a non-line of sight region around seeker system 40. In some embodiments, waveguiding structure 46 is symmetrically disposed along outer surface 41*a* or inner surface 42*a* to align with antenna elements 44.

For example, and as shown in FIG. 4, one antenna element 44*d* may be disposed proximate a second end 46*a* of waveguiding structure 46 and configured to receive signals or RF energy propagating from a first end (not shown) of waveguiding structure 46 to second end 46*a* of waveguiding structure 46.

Figure 5:
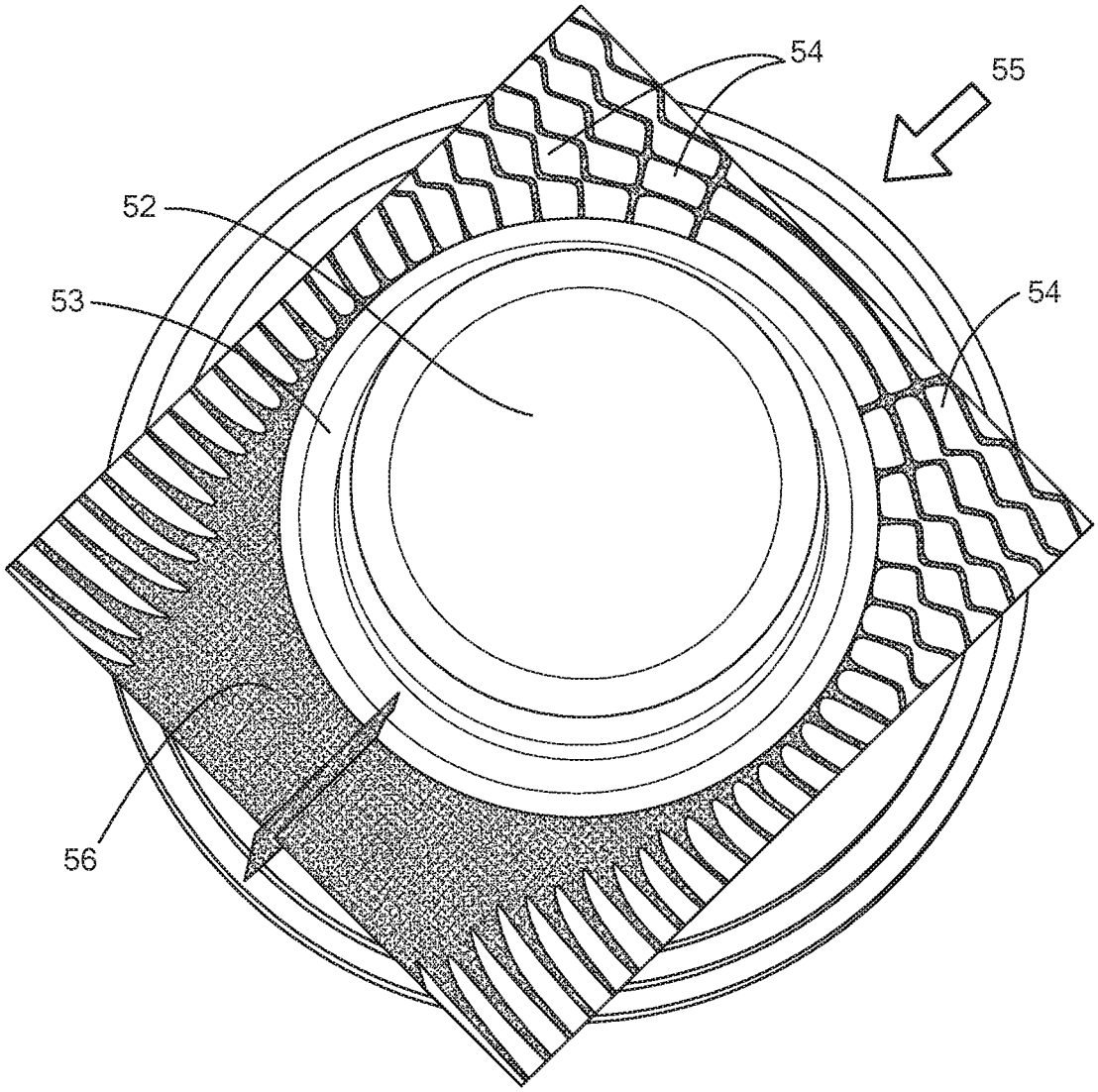
FIG. 5 is a top view of a seeker system illustrating one embodiment of the effects of shadowing on a seeker system.

Now referring to FIG. 5, seeker system 50 includes a sensor 52 and a pedestal 53, a line of sight region 54, a non-line of sight region 56 and incoming signals 55. As previously discussed, the structural size and shape of sensor 52 and pedestal 53 can create a shadowing effect on regions around seeker system 50. In the illustrative embodiment of FIG. 5, line of sight region 54 is positioned in front of sensor 52 and pedestal 53 and in a direct path of incoming signals 55 incident on seeker system 50. While, non-line of sight region 56 is positioned on a back side of sensor 52 and pedestal 53 and obstructed from receiving the incoming signals 55.

Figure 5A:
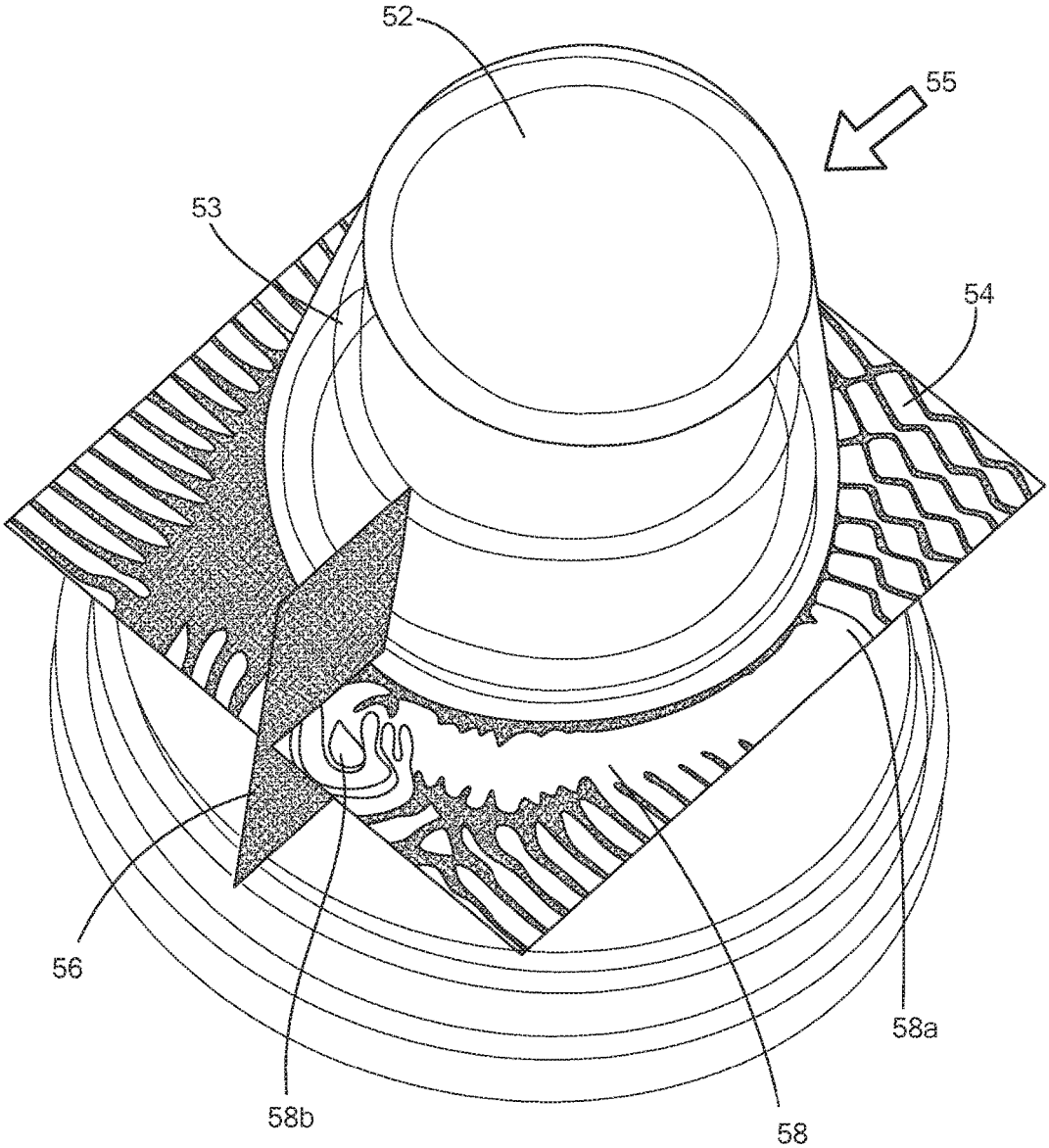
FIG. 5A is an angled isometric view of the seeker system of FIG. 5 with a waveguiding structure included.
Figure 5B:
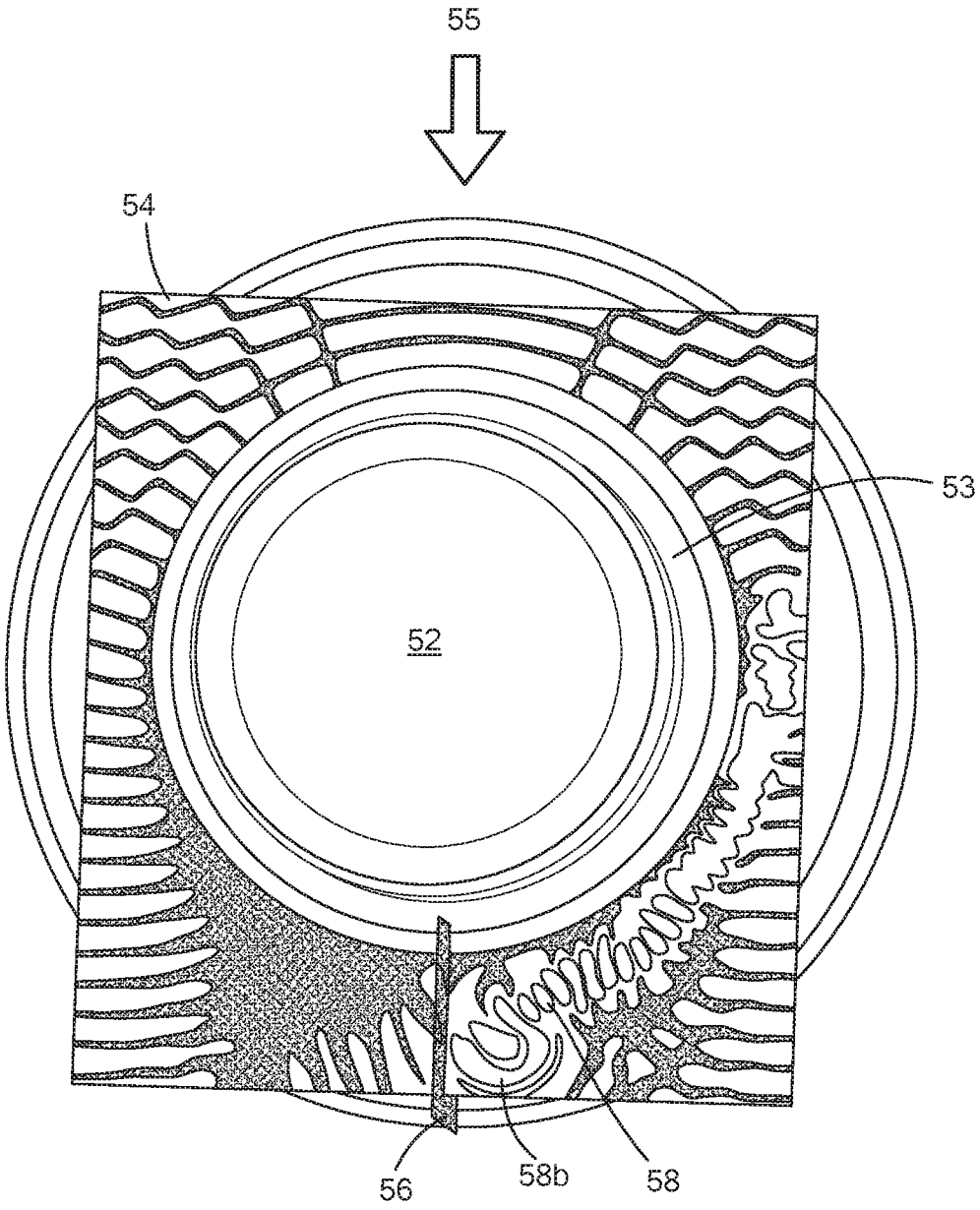
FIG. 5B is a top isometric view of the seeker system of FIG. 5 with the waveguiding structure included.

To couple and provide the incoming signals 55 to non-line of sight region 56 from line of sight region 54, and now referring to FIGS. 5A-5B, seeker system 50 includes a waveguiding structure 58. Waveguiding structure 58 has a first end 58*a* disposed in line of sight region 54 and a second end 58*b* disposed in non-line of sight region 56.

Thus, waveguiding structure 58 can be configured to improve signal levels in the shadowing region (i.e., non-line of sight region 56) around seeker system 50. In an embodiment, the waveguiding structure 56 couples incoming signals 55 (e.g., radiofrequency (RF) signals) from line of sight region 54 to non-line of sight region 56 (i.e., shadowing region). Antenna elements (not shown) disposed in the non-line of sight region 56 receive the transferred incoming signals 55 from the waveguiding structure 58. Thus, the shadowing region is reduced or eliminated as incoming signals 55 that were previously obstructed from reaching said shadowing regions are now provided via the waveguiding structure 58.

Now referring to FIG. 6, a seeker system 60 includes a sensor 62, a housing 63 and a pair of waveguiding structures 66*a*, 66*b*. The pair of waveguiding structures 66*a*, 66*b* are disposed along an outer surface 63*a* of housing 63. In the illustrative embodiment of FIG. 6, a first waveguiding structures 66*a* is disposed on top of a second waveguiding structure 66*b* and the pair of waveguiding structures 66*a*, 66*b* are in parallel with respect to each other along outer surface 63*a*.

In some embodiments, two or more waveguiding structures 66 may be disposed a predetermined distance from a neighboring or adjacent waveguiding structure 66. In other embodiments, the two or more waveguiding structures 66 may be disposed such that they are in contact with a neighboring or adjacent waveguiding structure 66.

A first end 67*a* of first waveguiding structure 66*a* may be aligned with a first end 67*b* of second waveguiding structure 66*b*. For example, first end 67*a* of first waveguiding structure 66*a* may disposed on top of and in parallel with first end 67*b* of second waveguiding structure 66*b*. In some embodiments, first 67*a* of first waveguiding structure 66*a* may disposed a predetermined distance from first end 67*b* of second waveguiding structure 66*b*. In other embodiments, first 67*a* of first waveguiding structure 66*a* and first end 67*b* of second waveguiding structure 66*b* may be disposed at different angles such that they do not line the same plane. The arrangement and positioning of any end of the waveguiding structures 66 may vary depending on a particular application or design of seeker system 60.

In an embodiment, waveguiding structures 66*a*, 66*b* are configured to receive signals 65 through first ends 67*a*, 67*b* at a same first region (e.g., line of sight region 64) around seeker system 60 and couple the received signals to a same second region (e.g., non-line of sight region 69) around seeker system 60.

For example and referring to FIG. 6A, first ends of first and second waveguiding structures 66*a*, 66*b* are disposed in a line of sight region 64 and second ends 68*a*, 68*b* are disposed in a non-line of sight region. First ends 67*a*, 67*b* of first and second waveguiding structures 66*a*, 66*b* receive signals 65 that are incident on seeker system 60. The received signals 65 propagate through first and second waveguiding structures 66*a*, 66*b* from first ends 67*a*, 67*b* to second ends 68*a*, 68*b*, where the received signals 65 are provided to non-line of sight region 69.

It should be appreciated that although FIGS. 6-6A, show a pair of waveguiidng structures 66*a*, 66*b*, any number of waveguiding structures may be used in seeker system 60 based on a particular application.

In an embodiment, waveguiding structures 66*a*, 66*b* can be configured to perform phase correction on incoming signal 65 (i.e., wave) to make the wave appear to be a plane wave to at least one antenna element disposed within seeker system 60.

For example, in an embodiment, two waveguiding structures (e.g., waveguiding structures 66*a*, 66*b*) may have the same length, with a first end of both waveguiding structures positioned in the same reference area (e.g., non-shadowing region, line of sight region) and a second end of both waveguiding structures position in the same second reference area (e.g., shadowing region). A signal received at the first end of both waveguiding structures will be in phase at the second end of both waveguiding structures. In some embodiments, a phase shifter may be disposed between the two waveguiding structures. The phase shifter may be configured to apply (enforce) a phase shift between the two waveguiding structures using as phase reference as the first end or waveguide entrance location. In some embodiments, the first end is in the line of sight region (i.e., illuminating region). In an embodiment with a phase shifter, the length of the waveguiding structures may not match as the phase shifter is configured to enforce the phase to match between the two ends.

In some embodiments, a phase correcting structure (not shown) may be disposed in one or more waveguiding structures 66*a*, 66*b* to perform phase correction. The phase correction structure may provide phase correction in a way that the incoming signal 65 (i.e., wave) looks like a plane wave to antenna elements disposed within seeker system 60. For example, the received signal 65 provided to the antenna elements may have substantially the same phase.

What is claimed:

1. A radome comprising:

a housing, which defines a radome cavity, said housing, having a first surface and a second surface;

at least one waveguiding structure, having a first end and a second end, said at least one waveguiding structure, disposed on a first one of the first and second surfaces of said housing, said at least one waveguiding structure extending in a circumferential direction around said radome cavity; and at least one antenna element disposed within the radome cavity, proximate the second end of the waveguiding structure, and configured to receive radio frequency (RF) energy propagating from the first end of said at least one waveguiding structure to the second end of said at least one waveguiding structure.

2. The radome of claim 1, further comprising:

a phase correcting structure disposed in said waveguiding structure.

3. The radome of claim 2, wherein said structure that provides a phase correction in a way that an incoming wave looks like a plane wave to the at least one antenna element such that RF signals provided to the at least one antenna element have substantially the same phase.

4. The radome of claim 1, wherein the at least one waveguiding structure has a helical shape.

5. An antenna comprising:

a radio frequency (RF) radome region;

a plurality of antenna elements disposed within the RF radome region, wherein the plurality of antenna elements are disposed around an inner surface of the RF radome region; and a first waveguiding structure positioned along the inner surface of the RF radome region, said first waveguiding structure extending in a circumferential direction around a cavity that is at least in part defined by the inner surface of the RF radorme region, wherein a first end of the first waveguiding structure is in a line of sight region of the antenna and a second end of the first waveguiding structure is in a non-line of sight region of the antenna.

6. The antenna of claim 5, wherein the first waveguiding structure is configured to couple RF energy received at the line of sight region to the non-line of sight region.

7. The antenna of claim 5, further comprising a second waveguiding structure positioned along the inner surface of the RF radome region.

8. The antenna of claim 7, wherein the second waveguiding structure is positioned parallel with respect to the first waveguiding structure within the RF radome region and both the first waveguiding structure and the second waveguiding structure have a helical shape.

9. The antenna of claim 8, wherein a first end of the second waveguiding structure is positioned a predetermined distance from a first end of the first waveguiding structure.

10. The antenna of claim 5, wherein the first waveguiding structure comprises a dielectric material.

11. The antenna of claim 5, wherein the first waveguiding structure is provided haying a tubular shape or rectangular shape.

12. The antenna of claim 5, wherein the first waveguiding structure is configured to perform phase correction on an incoming wave to make the incoming wave appear to be a plane wave to at least one of the plurality of antenna elements.

13. The antenna of claim 5, wherein the antenna elements are positioned at a bottom portion of the RF radome region with respect to a peak of the antenna.

14. The antenna of claim 5, wherein the antenna elements are positioned within a predetermined height of a height of the first waveguiding structure.

15. The antenna of claim 5, further comprising an infrared (IR) optics radome region coupled to a top surface of the RF radome region.

16. An antenna comprising:

a plurality of antenna elements disposed within a radome region of the antenna, wherein the plurality of antenna elements are disposed around an inner circumference of the radome region; and a first waveguiding structure positioned along the inner circumference within the radome region, said first waveguiding structure extending in a circumferential direction around a radome cavity that is at least in part defined by the radome region, wherein a first end of the first waveguiding structure is in a line of sight region of the antenna and a second end of the first waveguiding structure is in a non-line of sight region of the antenna.

17. The antenna of claim 16, wherein the first waveguiding structure is configured to couple RF energy received at the line of sight region to the non-line of sight region.

18. The antenna of claim 16, further comprising a second waveguiding structure positioned along the inner circumference within the radome region.

19. The antenna of claim 18, wherein the second waveguiding structure is positioned parallel with respect to the first waveguiding structure within the radome region, and both the first waveguiding structure and the second waveguiding structure have a helical shape.

20. The antenna of claim 18, wherein a first end of the second waveguiding structure is positioned a predetermined distance from a first end of the first waveguiding structure.

21. The antenna of claim 16, wherein the antenna elements are positioned at a bottom portion of the radome region with respect to a peak of the antenna.

22. The antenna of claim 16, wherein each of the plurality of antenna elements are disposed along a plane within the radome region, and wherein the plane is positioned at a predetermined distance from a height of the first waveguiding structure.

* * * * *